United States Patent [19]

Yang

[11] Patent Number: 4,584,621

[45] Date of Patent: Apr. 22, 1986

[54] TWO OR MORE THAN TWO POLES SWITCH MEANS HAVING UNEQUAL CONTACT GAPS AND TURN OFF CAPACITIES

[76] Inventor: Tai-Her Yang, 5-1, Tai-Pin St., Si-Hu Jenn, Chang-Hwa Hsien, Taiwan

[21] Appl. No.: 667,065

[22] Filed: Nov. 1, 1984

Related U.S. Application Data

[63] Continuation of Ser. No. 573,582, Jan. 23, 1984, abandoned, which is a continuation of Ser. No. 387,142, Jun. 10, 1982, abandoned.

[51] Int. Cl.[4] ..... H01H 33/14

[52] U.S. Cl. ..... 361/3; 200/10; 200/145; 335/201

[58] Field of Search ..... 335/107, 119, 127, 131, 335/133, 200, 201; 200/9, 10, 145; 361/3

[56] References Cited

U.S. PATENT DOCUMENTS

| | | | |
|---|---|---|---|
| 1,342,999 | 6/1920 | Hutt | 200/145 |
| 3,038,980 | 6/1962 | Lee | 200/145 X |
| 3,739,192 | 6/1973 | Oswald | 361/3 |
| 4,000,480 | 12/1976 | Gray et al. | 335/201 X |

FOREIGN PATENT DOCUMENTS

| | | | |
|---|---|---|---|
| 151237 | 10/1937 | Austria | 361/2 |

*Primary Examiner*—Harry E. Moose, Jr.
*Attorney, Agent, or Firm*—Cushman, Darby and Cushman

[57] ABSTRACT

A contact point structure for two pole or more than two pole switches and relays. Each pair of contact points has a different turn-off capacity and a different contact gap so that opening and closing the multi-pole switch will sequentially open or close the pairs of contact points thereby limiting arcing to only one pair of contact points.

5 Claims, 13 Drawing Figures

FIG. 6A
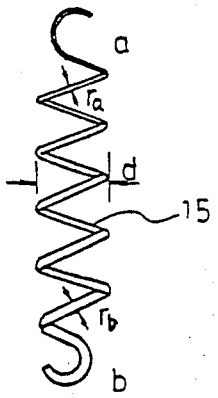
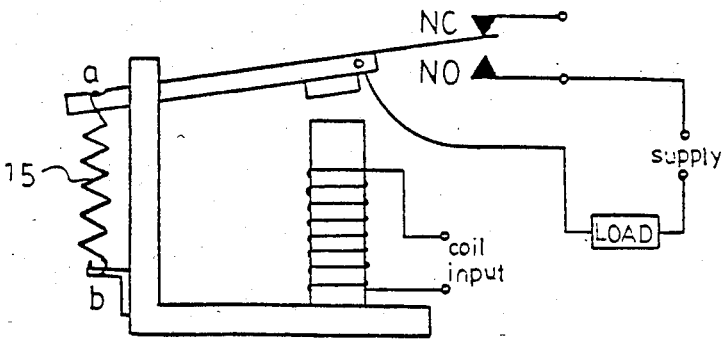
FIG. 6B

TWO OR MORE THAN TWO POLES SWITCH MEANS HAVING UNEQUAL CONTACT GAPS AND TURN OFF CAPACITIES

This is a continuation of application Ser. No. 573,582, filed Jan. 23, 1984, now abandoned, which is a continuation of Ser. No. 387,142, filed June 10, 1982, now abandoned.

This invention relates to electrical switches and relays. More particularly, it relates to switches having two or more poles which have unequal contact gaps and unequal turn-off capacities.

BACKGROUND OF THE INVENTION

All the current switches and relays have two rated capacities, i.e., the turn-off capacity and the conductive capacity which is usually higher than the former.

Since the contacts or the poles of the conventional multi-pole switch or relay are all the same size, the rated capacities of the switch are based on the size of the contacts. However, the design of this invention provides for multi-pole switches which have different sized contacts, one size for each pole. Therefore, multi-pole switches of the present invention can be rated based on the size of the largest set of contacts.

The size of positioning of the contacts is impotant with respect to the electrical arcing which occurs between the contacts whenever they are opened or closed. Arcing can damage the contact points, reducing their electrical performance and requiring their frequent replacement. In a multi-pole switch, these problems are multiplied by the number of contact points contained therein. The present invention provides a multi-pole switch in which arcing is effectively limited to one pair of contact points.

SUMMARY OF THE INVENTION

This invention relates to a two pole or more than two poles switch means having unequal contact gaps and turn-off capacities. The contact points of every pole have a different turn-off capacity and a different contact gap so that when the switch is turned on or off, the contacts open or close sequentially thus effectively limiting arcing to one pair of contacts and thereby increasing the serviceable life and safety of the multi-pole switch.

BRIEF DESCRIPTION OF THE DRAWINGS

FIG. 6 shows an embodiment of this invention being mechanically structured so as to use, as a damping means, a spring which has a constant diameter but a varying guage of wire.

Figure 1:
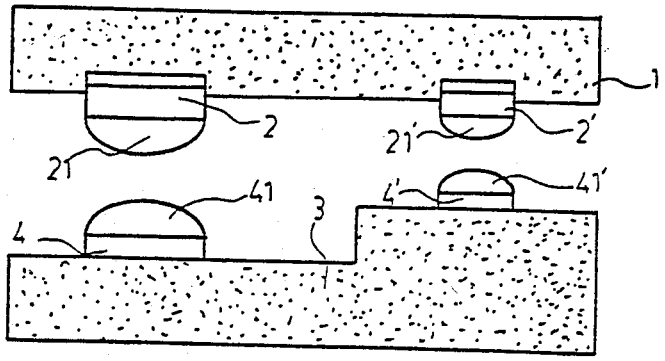
FIG. 1 shows the sectional view of a two-pole embodiment of this invention.

(A) Using two driving coils having different operation time (A.C.).

(B) A delay circuit connected in parallel across the driving coils of the small contact point pair (D.C.).

(C) A spark capacitor $C_2$ connected in parallel across the small contact point pair (D.C. or A.C.).

DETAILED DESCRIPTION OF THE PREFERRED EMBODIMENTS

Figure 2:
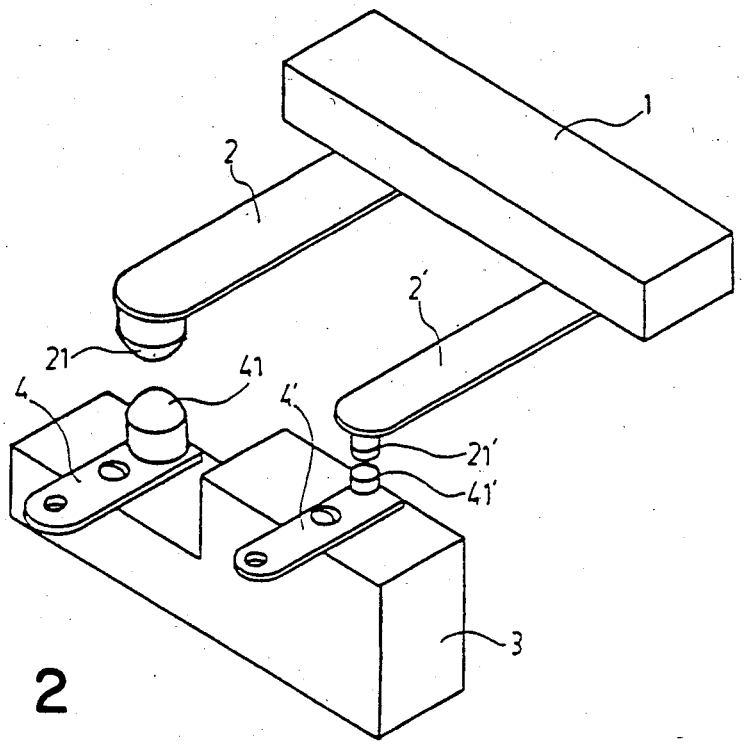
FIG. 2 shows the perspective view of FIG. 1.

This invention is further described in detail, by referring to the drawings attached, as follows:

FIG. 1 shows the sectional view of the two-pole embodiment of this invention, while FIG. 2 shows the perspective view of FIG. 1. As shown in FIG. 2, two armatures (2,2') are fixedly attached to an insulating base (1) which can move up and down. Each of the tips of said two armatures (2,2') is provided with a movable contact point (21, 21') respectively. The contact point (21) is bigger than the point (21'). On another insulating base (3), two fixed conducting pieces (4,4') are provided. On said conducting pieces (4, 4'), fixed contact points (41, 41'), corresponding to said contact points (21, 21'), are provided respectively. The contact point (41) is bigger than point (41').

FIG. 1 shows that the gap between the contact points (21) and (41), which form the big contact point pair, is wider than the gap between the contact points (21', 41'), which form the small contact point pair. Upon the switch being turned on, said small contact point pair (21', 41') will be closed first because it has the smaller gap. At this time, no spark is generated because only one terminal of the load is connected to the power. Subsequently, said two big contact points (21, 41) are closed and they bear the spark. By the same token, when the switch is turned off, the contact points (21, 41) will be separated first to bear the spark that may occur; and secondly, the small contact points will be separated with no sparking occuring therebetween. The structure of this invention is much superior in service life and safety than the conventional switch because sparking will occur at only one pair of contact points.

When this invention is used for a multi-pole switch or relay, the size (capacity) of the switch is based upon the turn-off capacity of the big contact point pair only. Therefore, the small contact points may be made of a highly conductive element with a low capacity and with little spark corrosion resistance. The big contact points may be made of an alloy which has a high capacity and withstands mechanical shock and spark corrosion so as to ensure the long life and safety of the switch.

Since every contact point has its specific gap, all the small contact point pairs except the one biggest contact point pair, may have a spring (not shown in FIGS. 1 and 2) furnished between the movable contacts and the movable armatures or between the fixed contacts and the insulating base in order to permit all the movable contacts to move up and down nearly, in accordance together with the elasticity of the spring, during the movement of the switch "ON" or to "OFF".

Since the switch in this invention has a specific turn-off sequence of its contact points, arcing is usually limited to the big capacity contact point pair. Therefore, said big contact point pair is usually installed on the live line side of a circuit. Furthermore, by means of the sequential opening and closing of the contact points, this invention may also be used as a relay which has a given operating sequence. The contact structure of this invention may also be used in the well-known field of manual switches (like knife switches), electro-magnetic switches, or relays.

Figure 3A:
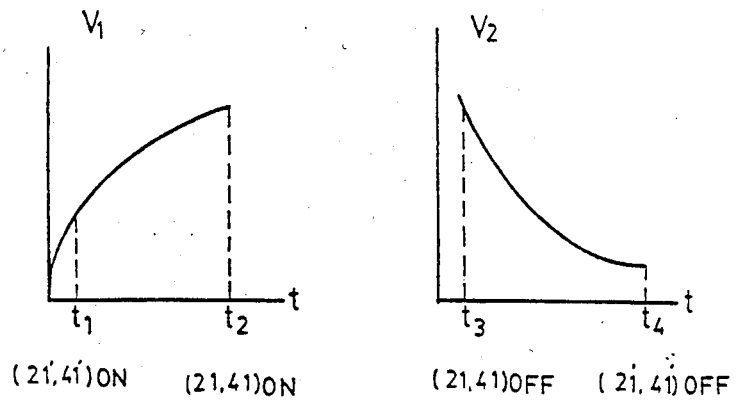
FIG. 3 is used to indicate the theory of operation of this invention.

Moreover, another feature of this invention is that, the opening or closing of the small contact point pairs may be electrically or mechanically delayed so that the turn-on speed of the switch may be expressed with an integral linear shape, and its turn-off speed may be expressed with a differential linear shape (as shown in FIG. 3A). In other words, during switch turn-off the switching speed of the small contact point pair is slower than that of the big contact point pair. Therefore, when the switch is turned off, the small contact point pair (which has a low capacity) remains in contact while the big contact point pair (which has a high capacity) opens up and neutralizes the circuit. Since the big contact point pair is the only one which bears a spark, and it has a high capacity, the time during which the switch is arcing is greatly reduced, thereby increasing the efficiency of the switch.

Figure 3B:
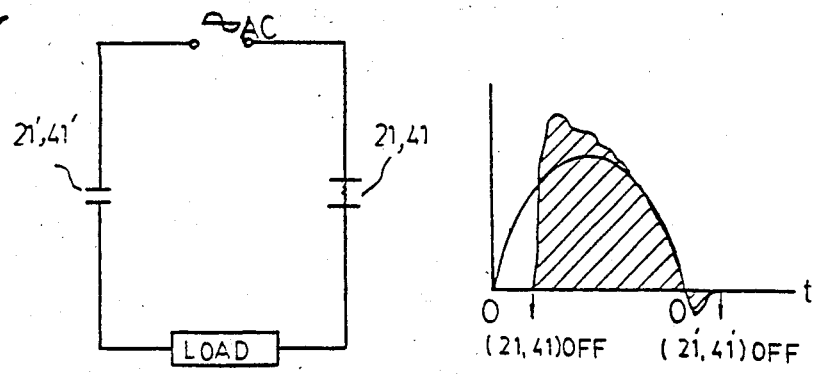

As shown in FIG. 1 and FIG. 3B, upon the swithch being turned on the small capacity contact point pair (21', 41') becomes conductive first. Since only one terminal of the load is connected, no spark is generated. Upon the switch being turned off, the big contact point pair (21, 41) is cut off first. In case the small contact point pair is opened too fast, a spark may occur between the small contact points (21') and (41') because the big contact points had not finished arcing and the small contact points were not completely cut off from the load within the given time period of time.

Therefore, a further feature of this invention is that, upon the switch being turned off, the cutting off operation of the small contact point pair should be slower by over 8.6 ms (Since the frequency of power line is 60 HZ per second, one half cycle is about 8.6 ms) than the big contact point pair. Therefore, the small contact point pair should remain in contact during the time it takes the big contact point pair to drop below the zero voltage level in order to completely eliminate the spark or arc in the small contact point pair. Then, the small contat point pair can be cut off without generating any spark because of having no load to be cut. (as shown in FIG. 3B).

The means by which the small or big contact point pair may be electrically or mechanically delayed when opening or closing are described below:

| Type | No. | Structure | Used for | FIG. Referred |
|---|---|---|---|---|
| Mechanical | 1 | An opposite concavo-convex mechanical damping structure between the knife and the pivot piece of a knife switch. | Knife Switch (Manual switch) | 4 |
| | 2 | Air-pocket type of damping means. | Electro-magnetic switch or relay. | 5 |
| | 3 | Two or more springs which have equal diameter with different gauged wires. | Electro-magnetic switch or relay | 6 |
| Electric | 4 | A.C. Two or more sets of driving coils which have different operation times. | Electro-magnetic switch or relay | 7A |
| | | D.C. A delay circuit connected in parallel across the driving coil of the small contact points. | Electro-Magnetic switch or relay | 7B |
| | | A.C. or D.C. An spark capacitor connected in parallel across the two ends of the small contact points. | Electro-magnetic switch or relay | 7C |

Figure 4A:
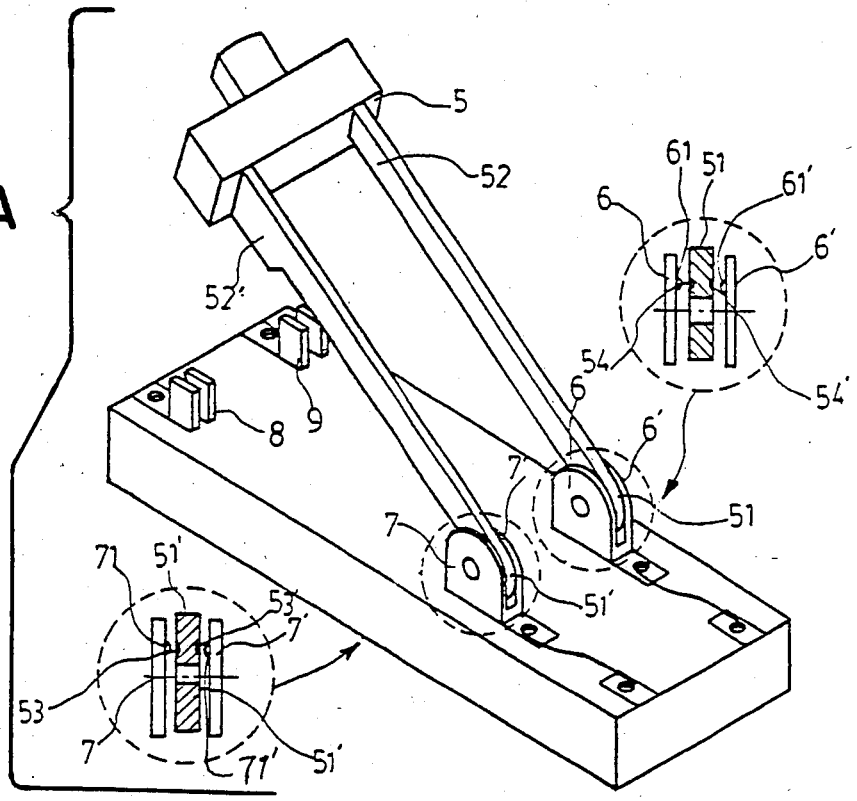
FIG. 4 shows an embodiment of this invention being mechanically structured so as to be used as a two-pole knife switch.

The aforesaid means are further described in accordance with the numbered sequence in the table above as follows:

1. As shown in FIG. 4A, a mechanical damping structure is used in a knife switch. At both sides of the knife feet (51, 51') and near the joint to the pivot pieces (6, 6') and (7, 7'), four pits (53, 53') and (54, 54') are furnished. On the surface of the pivot piece that is opposite to said pits, four salient half beads (61, 61') (71, 71') are furnished correspondingly. Said two knife feet (51, 51') are respectively pivoted between said pivot pieces (6, 6'), and said pivot pieces (7, 7'). When the knife is moved along and arc under the salient half-beads of the pivot pieces come into contact with the pits of knife feet, a slightly mechanical damping or delaying effect will be resulted.

Where the position of the salient half-beads of the pivot pieces has approximately been arranged, the contact point (8) (corresponding to the small contact point pair) will, during the closing of the knife switch, be contacted first because the front end of the blade (52') of the knife is wider than that of (52). When the pit of the knife foot and the salient half-bead of the pivot piece make contact, a mechanical delaying effect will result for a short period of time; then, the other knife blade (52) will contact with the contact point (9) (corresponding to the big contact point).

Figure 4B:
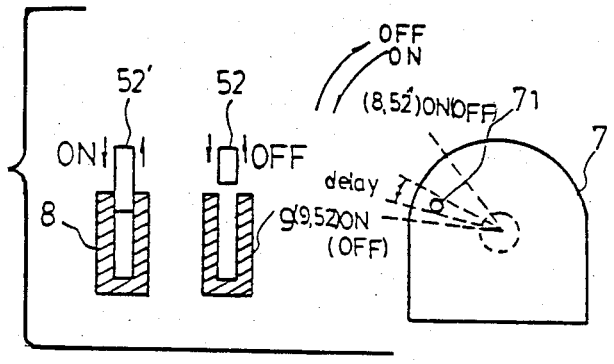
Figure 4C:
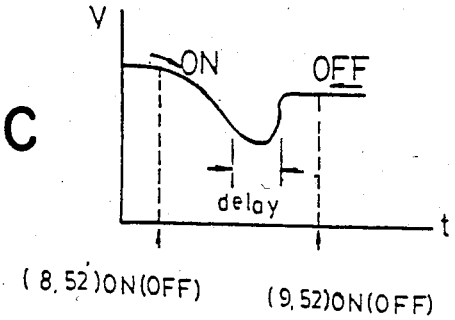

By the same token, upon turning off the switch, the contact point (9) will be cut off first, and after a given period of delay time (the delay time generated with said mechanical damping method should not be longer than 8.6 ms), the contact point (8) will be cut off. The relations of the operation speed between said contact points are shown in FIGS. 4B and 4C.

Figure 5:
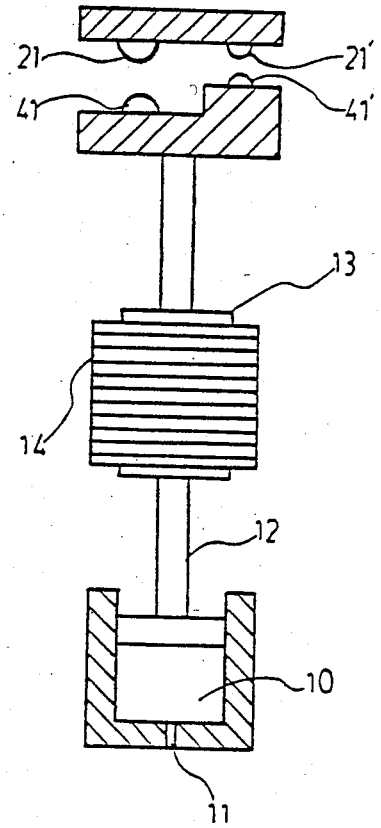
FIG. 5 shows an embodiment of this invention being mechanically structured so as to use an air-pocket type of damping means.

2. FIG. 5 shows an embodiment of air-pocket type damping means to generate the aforesaid delay function. Said means comprises an air-pocket (10) with a ventilation hole (11), a piston (12), an iron core (13), and a coil (14). Upon the piston (12) being moved up and down, as a result of the magentic force, in an air-pocket having damping effect, the big contact point fixed at the other end of said piston will be slower to come into contact when the switch is turned on. Upon the switch being cut off, the cutting off time of said small contact points (21', 41') will lag behind the cutting off time (8.6 ms) of the big contact points (21, 41) so as to obtain the results of increasing the non-arcing time and thereby increase the switch efficiency.

3. FIG. 6B shows a damping mechanism comprising a spring having equal diameter with different gauged wire to be used in a relay. Said spring (15) is further shown in FIG. 6A, in which the wire diameter ($r_a$) at terminal (a) is smaller and becomes gradually thicker and thicker till terminal (b) (i.e. $r_b$ $r_a$), but the diameter (d) of the whole spring is identical. As a result, when applying an equal force to compress or to pull said spring to a given distance, the time required at terminal (a) is shorter than that of terminal (b). When the external force is removed, the returning force at terminal (b) is greater because of its wire diameter being bigger; likewise, the time required to return to the original point at terminal (b) is shorter than that of terminal (a).

By means of said characteristics, it could be possible to put two said springs on the two poles of a relay which has the same contact point structure as FIG. 1, and set the position of terminal (a) and (b) reversely. If the relay has more than two poles, the arrangement of said springs is based on the load cutting off condition and the characteristics of the contact points.

In FIG. 6B, the small contact point is turned on first when the relay is switched to "N.O." contact. Upon returning to the normal state, the big contact point will turn off first. Since the force is applied to the terminal (a) of the actuating spring (15) of the small contact point pair, its actuating time required is at least 8.6 ms later than that of the big contact point.

4. The fourth method to obtain the same delaying function mentioned in this invention is by using electric components, which may be applied in A.C. or D.C. circuits.

FIG. *7a* shows an A.C. circuit in which two driving coils (16,17), having different operation times, are used for driving said small contact point pair (21', 41') and said big contact point pair (21, 41) respectively.

Figure 7A:
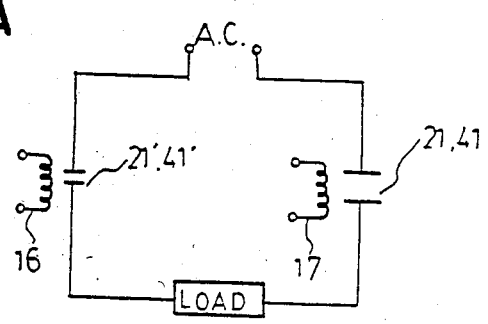
FIG. 7 shows three embodiments of this invention being electrically structured so as to use.
Figure 7B:
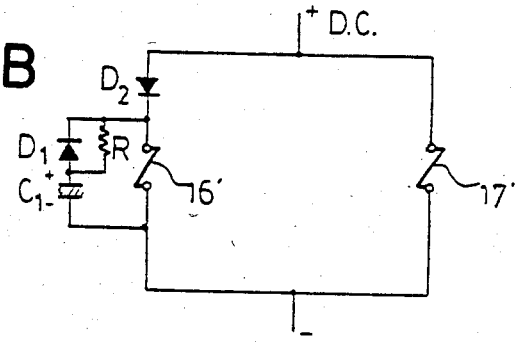

FIG. 7B shows a D.C. circuit, in which a delay circuit comprising a resistor, a capacitor, and a diode, is connected in parallel to the driving coil (16') of said small contact point pair (21', 41'). Upon the switch being turned on, the current will flow thru $D_2$ and R, and charge $C_1$ to the saturation state. Upon the switch being turned off, the big contact point pair (21, 41) will be cut off first, and said capacitor $C_1$ will, thru $D_1$ and the driving coil (16'), discharge so as to have the small contact point pair maintained in contact by means of the discharging current thru the driving coil. When the discharging current stops flowing in said coil, the small contact point pair will be cut off. The other diode $D_2$ would cut off the discharge of said capacitor $C_1$ to the driving coil (17') of the big contact point pair.

Figure 7C:
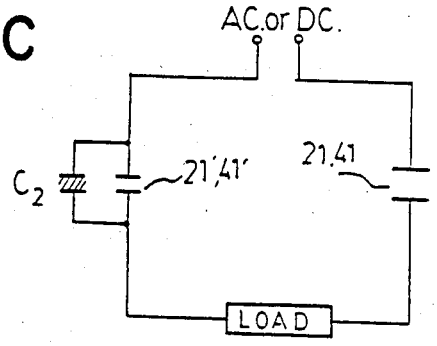

Further, there is an insert AC/DC, in which an spark capacitor $C_2$ is connected across the small contact point pair as shown in FIG. 7C. Upon the switch being cut off, said big contact point pair will be cut off first; under these circumstances, even the small contact point pair is cut off before the big contact point pair completing arcing however, said small contact point pair will not generate any spark because of the by-pass discharging effect of said capacitor.

I claim:

1. A multi-pole switch for sequentially opening and closing conductive paths comprising:

a first contact point pair defining a gap therebetween;

a second contact point pair defining a gap therebetween; and opening and closing means for closing said second contact point pair prior to closing said first contact point pair, and opening said second contact point pair after opening said first contact point pair wherein said opening and closing means includes a knife switch comprising:

a first knife switch contact point;

a second knife switch contact point;

a first knife blade for contacting said first contact point, and having an extension portion for controllably contacting said first contact point;

a second knife blade for contacting said second contact point;

first pivot means for securing said first knife blade and about which said first knife blade is pivotable; and delaying means for retarding the pivoting knife blades while said extension portion of said first knife blade is in contact with said first contact point but said second knife blade is not in contact with said second contact point.

2. A multi-pole switch according to claim 1 wherein said delaying, means includes:

A pit in each of said pivot means adjacent to where said knife blades are secured thereto;

a salient half-bead in each of said knife blades such that said salient half-bead will contact said pit when said knife blade is pivoted about said pivot means; and said pits and said salient half-beads being so positioned that said salient half-beads engage said pits when said extension portion of the first knife blade is in contact with said first contact point but said second knife blade is not in contact with said second point.

3. A multi-pole switch for sequentially opening and closing conductive paths comprising:

a first contact point pair defining a gap therebetween;

a second contact point pair defining a gap therebetween, and opening and closing means for closing said second contact point pair prior to closing said first contact point pair, and opening said second contact point pair after opening said first contact point pair;

wherein the gap between said first contact point pair is greater than the gap between said second contact point pair and wherein said opening and closing means includes an air-pocket damper comprising:

air pocket containing means for containing an air pocket;

a piston positioned movably within said air pocket containing means;

attaching means for rigidly attaching said piston to said first and second contact point pairs;

an iron core attached to said attaching means;

coil means, attached to said iron core, so that when said coil means is energized, the resultant magnetic force will cause said piston to move up or down within said air pocket containing means, and ventilation means, located in said air pocket containing means, for allowing a controlled amount of air to enter or escape from said air pocket containing means such that said piston means moves slowly enough that said second contact point pair is closed to prior to said first contact point pair, but said second contact point pair is opened after said first contact point pair.

4. A multi-pole switch for sequentially opening and closing conductive paths comprising:

a first contact point pair defining a gap therebetween;

a second contact point pair defining a gap therebetween; and opening and cloing means for closing second contact point pair prior to closing said first contact point pair, and opening said second contact point pair after opening said first contact point pair;

wherein the gap between said first contact point pair is greater than the gap between said second contact point pair and wherein said opening and closing means includes spring delaying means for delaying the opening of said second contact point pair comprising:

a spring connected to one contact point in each contact point pair, each of said springs having a constant diameter but varying in gauge from thin gauge at one of said spring to thick gauge at the other end of said spring; and spring support structure means for supporting said springs such that the spring connected to the first contact point pair is positioned reversedly from the spring connected to said second point pair so that when said switch is opened, said first contact point pair opens prior to said second contact point pair, but when said switch is closed, said second contact point pair is closed prior to said first contact point pair.

5. A multi-pole switch for sequentially opening and closing conductive paths comprising:

a first contact point pair defining a gap therebetween;

a second contact point pair defining a gap therebetween; and opening and closing means for closing said second contact point pair prior to closing said first contact point pair, and opening said second contact point pair after opening said first contacting point pair;

wherein the gap between said first contact point pair is greater than the gap between said second contact point pair and wherein said opening and closing means includes a D.C. delaying circuit comprising;

a D.C. source means;

a first drive coil for controlling the opening and closing of said first contact point pair;

a second driving coil for controlling the opening and closing of said second contact point pair, said second driving coil having a first end and a second end;

a first diode connected in series between said first end of said second driving coil and said D.C. source means said first diode being biased away from said D.C. source, delay circuitry connected in parallel across said second driving coil, said circuitry comprising:

a capacitor connected to said second end of said second driving coil;

a second diode connected in series with said capacitor and attached to said first end of said second driving coil, said diode being biased toward said first end of said second driving coil; and a resistor connected in parallel to said second diode such that when energy is removed from said D.C. circuit, said delay circuitry operates to inhibit the deactivation of said second driving coil thus delaying the opening of said second contact point pair.

* * * * *